United States Patent [19]

Tsopelas

[11] 4,343,353

[45] Aug. 10, 1982

[54] AUTOMOBILE RADIATOR FILTER

[76] Inventor: John Tsopelas, 15 Canlish Rd., Suite No. 2, Scarborough, Ontario M1P 1S5, Canada

[21] Appl. No.: 210,425

[22] Filed: Nov. 26, 1980

[51] Int. Cl.[3] ..... F28F 19/00

[52] U.S. Cl. ..... 165/119; 210/805; 210/117; 210/136; 210/167; 137/549; 137/590; 123/41.08; 123/41.54

[58] Field of Search ..... 165/119; 123/41.02, 123/41.08, 41.15, 41.54; 137/549, 571, 590; 210/805, 117, 136, 167, 455, 473, 474

[56] References Cited

U.S. PATENT DOCUMENTS

| | | | |
|---|---|---|---|
| 1,832,776 | 11/1931 | Hudson | 123/41.15 |
| 2,127,271 | 8/1938 | Schenk | 123/41.21 |
| 2,488,806 | 11/1949 | Crowder | 210/167 |
| 2,672,853 | 3/1954 | Dunnigan | 123/41.08 |
| 2,879,975 | 3/1959 | Doi | 165/119 |
| 3,362,536 | 1/1968 | Sellman | 210/167 |
| 3,540,528 | 11/1970 | Moon | 165/119 |
| 3,682,308 | 8/1972 | Moon | 210/167 |
| 3,726,262 | 4/1973 | Moon | 165/119 |
| 4,018,270 | 4/1977 | Kolinger | 165/119 |
| 4,260,012 | 4/1981 | Suarez | 210/435 |

*Primary Examiner*—Ernest G. Therkorn
*Attorney, Agent, or Firm*—Rogers, Bereskin & Parr

[57] ABSTRACT

The invention relates to method and apparatus for filtering engine coolant flowing in the cooling system of an automotive internal combustion engine. The method consists of constraining engine coolant which normally discharges from an overflow port in the cooling system radiator to pass through a filter into a reservoir, and of applying the suction normally produced at the overflow port as the cooling system cools to draw the filtered engine coolant back into the cooling system.

21 Claims, 2 Drawing Figures

AUTOMOBILE RADIATOR FILTER

Figure 1:
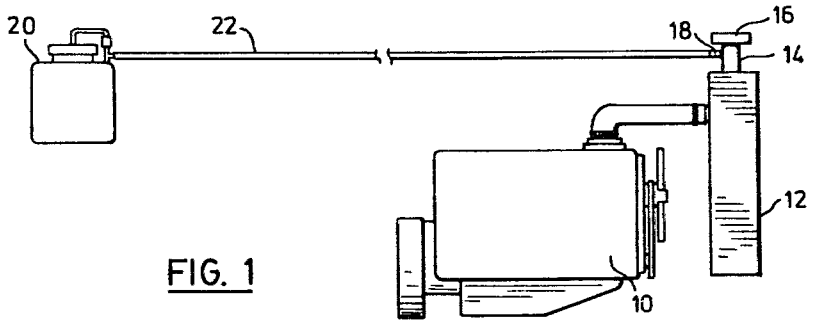

The invention relates to method and apparatus for filtering the engine coolant circulating in the cooling system of an automotive internal combustion engine.

In the past a variety of radiator or coolant system filters have been proposed for use with automotive internal combustion engines. Some of these devices, such as those described in the following U.S. patents, are intended for direct or in line installation in an automobile cooling system whereby all coolant is constrained to circulate through the filtering device: U.S. Pat. No. 3,362,536 issued Jan. 9, 1968 citing D. L. Sellman as inventor; and, U.S. Pat. No. 3,682,308 issued on Aug. 8, 1972 citing C. L. Moon as inventor.

A problem with such devices is that substantially all cooling system fluid must circulate through such filters, and consequently a breakdown or clogging of such filters may require engine shutdown. Thus, measures must be taken to by-pass such a device should its function breakdown, sometimes by providing an elaborate internal by-pass.

A number of prior devices have proposed the diversion of a portion of the coolant flow in an internal combustion engine cooling system through a filter. Typical devices of this type are described in U.S. Pat. No. 2,488,806 which issued on Nov. 22, 1949 citing C. D. Crawder as inventor, and U.S. Pat. No. 2,672,853 which issued on Mar. 23, 1959 citing J. L. Dunnigan as inventor. Although clogging of such devices does not immediately affect cooling system function, the pumping action of a cooling system circulating pump is still required to draw radiator coolant through the device, and consequently the devices are not very readily installed in a conventional automobile cooling system.

In present day automotive engines a tendency exists for engine coolant to overflow from an overflow port provided in the engine's radiator. Such an overflow can occur during operation of the engine when such operation causes an overheating of the engine cooling system, and also when the engine is shutdown after operation, with a sudden delivery of engine heat to portions of the cooling system. This tendency of an internal combustion engine cooling system to periodically overheat, even as a part of normal operation, has been recognized by automobile manufacturers who commonly provide a reservoir to capture the liquid coolant discharged from the radiator. As such a cooling system cools, as, for example, when an automobile is moved from stop and go operation to continuous operation on a highway, or when the engine is shutdown for an extended period of time, suction occurs at the radiator overflow port, tending to draw engine coolant back into the cooling system from the reservoir.

In contrast to prior art, the present invention does not use the pumping action of a circulating pump to circulate engine coolant through a filter. Instead, the present invention takes advantage of the tendency of present day automotive engines to discharge radiator fluid when overheated, and to provide suction at the radiator overflow port when cooling, to draw engine coolant through a filter.

Thus, in a first aspect, the invention provides a method of filtering engine coolant comprising the steps of constraining engine coolant that overflows from an automotive cooling system to pass through a filter into a reservoir, and and of applying the suction produced when the cooling system cools to draw filtered engine coolant from the reservoir back into the cooling system.

In another aspect the invention provides filtering apparatus embodying the above method. The filtering apparatus comprises a filter having an inlet for receiving engine coolant to be filtered, and an outlet for releasing the filtered engine coolant to a reservoir, in fluid communication with the filter outlet, which stores the filtered engine coolant. A system of conduits serves to place both the filter inlet and the interior of the reservoir into fluid communication with the overflow port of the engine cooling system. Valves are provided to direct the flow of fluids through the conduit so that in use engine coolant overflowing from the overflow port of the cooling system is forced through the filter into the reservoir, and so that the suction provided at the overflow port when the cooling system cools draws filtered engine coolant from the reservoir back into the cooling system.

Figure 2:
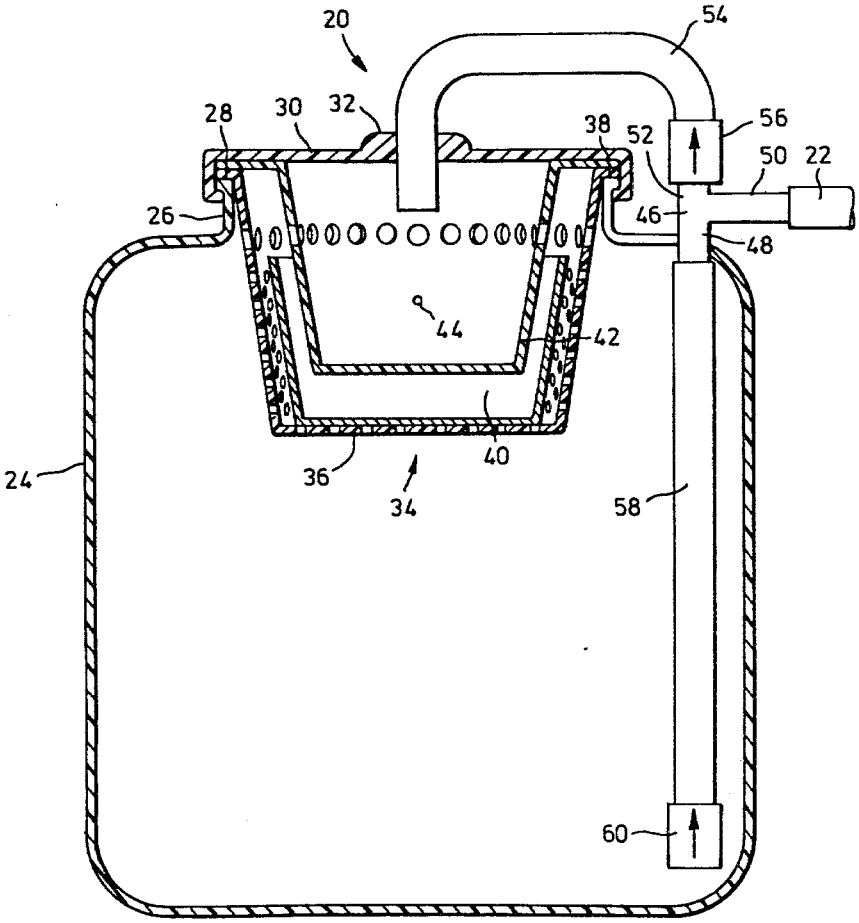

The invention will be better understood with reference to drawings in which:

FIG. 1 diagramatically illustrates filtering apparatus embodying the invention in use with a conventional combustion engine and cooling system; and, FIG. 2 is a partially sectioned, elevational view of the filtering apparatus.

Reference is made to FIG. 1 which diagramatically illustrates an automotive internal combustion engine 10 which has a conventional cooling system, including a radiator 12. A sleeve 14 extends upwardly from the radiator 12, and a radiator cap of conventional construction is mounted on the sleeve 14. The sleeve 14 and cap 16 house a pressure relief valve (not illustrated) of conventional construction, which normally seals the radiator 12 and cooling system until some predetermined pressure level is exceeded in the radiator 12.

When the predetermined pressure is exceeded, in the radiator 12 as it frequently will be during the normal operation of the internal combustion engine 10, the pressure release valve permits the discharge of coolant through an overflow port, a nipple 18, on the sleeve 14. When the internal combustion engine cools, a vacuum tends to develop in the radiator 12, and the pressure release valve opens so that suction is applied at the nipple 18. Such a radiator system and the operation described is conventional, and in a present day automobile it would be common to provide a reservoir, in fluid communication with the nipple 18, to store overflowing engine coolant and to permit return of the engine coolant so stored under the suction applied at the nipple 18 when the engine cools.

FIG. 1 also illustrates filtering apparatus 20 (a preferred embodiment of apparatus constructed according to the invention) which is placed in fluid communication with the nipple 18 by means of a length of rubber tube 22. The filtering apparatus 20 is better illustrated in the part-sectioned view of FIG. 2.

The filtering apparatus 20 includes a plastic reservoir 24 which can contain about 2 liters of engine coolant. (A reservoir of larger or smaller volume can be used to accommodate engines and cooling systems of different size, but the reservoir 24 should be satisfactory for most automotive applications). The reservoir 24 has a neck having a rim 28 which circumscribes an opening (not specifically indicated) accessing the interior of the reservoir 24. The reservoir 24 is provided with a plastic cap 30 moulded with a retaining ring 32 having an aperture (not specifically indicated) dimensioned to secure tubing described more fully below. The cap 30 is intended to be snapped onto the neck 26.

The filtering apparatus 20 includes a filter assembly 34. The filter assembly 34 has a cup-shaped plastic filter housing 36 which is suspended from the rim 28 of the reservoir 24 by means of an annular flange 38 which circumscribes an open, upper end of the filter housing 36.

The filter housing 36 is provided on its bottom and around its sides with a multiplicity of apertures of about 1 m.m. diameter (not specifically indicated). (The filter housing 36 can be constructed os a screen-like material, if desired). The apertures permit engine coolant flowing into the upper end of the filter housing 36 to be drawn by gravity into the interior of the reservoir 24. A generally cup-shaped filter paper 40, of the type commonly used in drip coffee makers, is rested in the bottom of the filter housing 36 to filter the engine coolant. To ensure that engine coolant can enter the interior of the reservoir 24 even if the filter 40 becomes clogged, the filter housing 36 is provided with a plurality of large overflow holes of ¼ inch diameter (not specifically indicated) disposed about 1 centimeter above the top of the filter paper 40.

The filtering apparatus 20 includes a substantially cup-shaped plastic trap 42 intended to trap heavy sediment carried by the engine coolant, before sediment can deposit on the filter paper 40. The trap 42 has an open end (not specifically indicated) positioned to receive engine coolant delivered through the cap 30, and a body portion in which the engine coolant can accumulate.

A single aperture 44 permits escape of engine coolant from the trap 42, but a plurality of large overflow holes of ¼ inch diameter (not specifically indicated) are provided above the aperture 44 to ensure that engine coolant can flow freely from the trap 42 in the event that the aperture 44 becomes clogged or in the event that a very substantial quantity of engine coolant is delivered to the trap 42. In operation, engine coolant delivered at the open end of the trap 42 escapes through the aperture 44 or the overflow holes leaving behind heavy sediment, and then passes through the filter paper 40 which removes fine debris.

The filtering apparatus 20 comprises a T-connector 46 having a first end 48 secured in a wall of the plastic reservoir 24, and a second end 50 which is placed in fluid communication with the nipple 18 of the radiator 12 by means of the rubber tube 22.

A third end 52 of the T-connector 46 is in fluid communication with a coolant inlet tube 54 which delivers engine coolant to the upper end of the filter housing 36 for filtering. The tube 54 passes through the aperture in the retaining ring 32, which is dimensioned to closely receive the tube 54. A conventional check valve 56 permits engine coolant overflowing from the nipple 18 to flow into the upper end of the filter assembly 34, but closes to prevent air from being drawn into the radiator system when a vacuum is applied at the nipple 18. (The check valve 56 permits the flow of liquid coolant and air only in the direction indicated by the arrow on the valve 56).

The filtering apparatus 20 comprises a coolant outlet tube 58 in fluid communication with the interior of the reservoir 24 so that filtered engine coolant can be drawn by the vacuum periodically applied at the nipple 18 from the reservoir 24.

It will be appreciated that the tube 58 has the bottom of the outlet tube 58 must be immersed in engine coolant so that the radiator 12 does not draw air into the cooling system when cooling. A check valve 60 located at the bottom thereof to ensure that unfiltered engine coolant overflowing from the radiator is not forced into the reservoir 24 without first passing through the filter assembly 34. (The check valve 60 permits the flow of engine coolant only in the direction indicated by the arrow on the check valve 60).

The filtering apparatus 20 can be installed in an automobile and operated as described below.

If the automobile has a recovery system, the overflow reservoir of the cooling system can simply be replaced with the filtering apparatus 20. If the automobile is not equipped with such a cooling system, the filtering apparatus 20 should be installed under the hood of the automobile, generally near the radiator where there will probably be some available space. The filtering apparatus 20 can be suspended from the body of the automobile in any suitable manner.

Once the filtering apparatus 20 is installed, the trap 42 and filter housing 34 should be lifted from the reservoir 24. The reservoir 24 can then be filled about half-way with liquid engine coolant (about 1 liter). The operator should also ensure that the automobile radiator is substantially full. If after operation, when the engine is cooled, the reservoir 24 appears to have lost engine coolant, further engine coolant should be added to the vehicles cooling system; and this should be done by adding the additional coolant to the reservoir 24, in the manner just described, rather than adding the coolant directly to the automobile radiator.

The filter housing 34 is then suspended by means of its flange 38 from the rim 28 of the reservoir 24. A filter paper such as the filter 40 is then inserted into the filter housing 34. The trap 42 is then suspended by means of its flange 43 from the rim 28. The cap 30 is then pressed onto the neck 26, thereby securing the filter housing 34 and trap 42 to the reservoir 24.

It should be noted that the cap 30 need not be air tight. In fact, the reservoir 24 should be vented so that the discharge of engine coolant into the reservoir 24 is not impeded by any back pressure. If necessary, a small aperture or vent should be provided at an upper end of the reservoir 24.

A tube such as the tube 22 should be used to place the filtering apparatus 20 into fluid communication with the overflow port of the automobile radiator. The filtering apparatus 20 is then ready to filter engine coolant during the operation of the automobile.

If the automobile is old, and its radiator has not been regularly flushed, it is recommended that the filter 40 be removed every two to three days and replaced. If the operator fails to do so, the filter 40 will tend to clog. Engine coolant flowing into the filtering apparatus 20 will then escape through the overflow holes provided in the filter housing 44. In such circumstances, the reservoir 24 will act as a conventional coolant recovery reservoir, and there is consequently no danger of damage to the radiator or engine if the filter 40 clogs.

Filtering apparatus embodying the invention can be constructed in a variety of ways. For example, a filtering element need not be located inside the reservoir, but can instead be located in the line, such as the tube 22, which places the reservoir of the filtering apparatus in fluid communication with the overflow port of the automobile radiator. Such a filter may have a tendency to clog, thereby creating a risk of damage to the engine cooling system and engine itself, and may be difficult to access to replace filter components. For these reasons, the filtering apparatus 20 is greatly preferred.

It will be appreciated that the filtering apparatus 20 is a preferred embodiment of the invention, and that a variety of modifications may be made thereto without departing from the spirit of the invention.

I claim:

1. Filtering apparatus for use in association with an internal combustion engine cooling system having overflow port means permitting overflow of liquid engine coolant when the cooling system overheats and providing suction as the cooling system cools, comprising:

filtering means for removing debris from engine coolant passing through the filtering means, including filter inlet means for receiving engine coolant to be filtered and filter outlet means for releasing filtered engine coolant;

a reservoir in fluid communication with the filter outlet means for receiving and containing the filtered engine coolant;

conduit means for placing each of the filter inlet means and the interior of the reservoir into fluid communication with the overflow port means to permit flow of engine coolant therebetween; and, valve means for directing the flow of fluids through the conduit means so that in use (a) engine coolant overflowing from the overflow port means is forced through the filter means into the reservoir, and (b) the suction provided at the overflow port means when the cooling system cools draws filtered engine coolant from the reservoir.

2. Filtering apparatus as claimed in claim 1 in which the conduit means comprise:

a coolant inlet conduit in fluid communication with the filter inlet means so that engine coolant can be passed through the coolant inlet conduit into the filter means; and, a coolant outlet conduit in fluid communication with the reservoir so that filtered engine coolant can be drawn through the coolant outlet conduit from the reservoir.

3. Filtering apparatus as claimed in claim 2 in which the valve means comprise:

an inlet check valve disposed in the coolant inlet conduit to permit flow of engine coolant in the inlet conduit only towards the filter inlet means; and, an outlet check valve disposed in the coolant outlet conduit to permit flow of engine coolant in the outlet conduit only away from the reservoir.

4. Filtering apparatus as claimed in claim 1 in which the filter means are located in the interior of the reservoir.

5. Filtering apparatus as claimed in claim 4 in which:

the reservoir comprises a neck having a rim, an opening circumscribed by the rim and accessing the interior of the reservoir, and a cap for closing the opening; and, the conduit means deliver engine coolant to the filter inlet means through an aperture in the cap, whereafter the engine coolant can be drawn by gravity through the filter means into the reservoir.

6. Filtering apparatus as claimed in claim 5 in which the filter means comprise:

a filter housing comprising a cup-chaped body portion having an open end disposed to receive engine coolant delivered through the cap, and having at least one aperture for releasing the engine coolant to the reservoir; and, a sheet-like filtering material replaceable through the opening in the reservoir and so disposed in the filter housing that engine coolant delivered to the housing by the conduit means passes through the sheet of filtering material before being released to the reservoir.

7. Filtering apparatus as claimed in claim 6 in which the filter housing comprises at least one overflow aperture located above the sheet-like filter material when the sheet-like material is positioned in the filter housing to filter engine coolant, whereby engine coolant can escape from the filter housing when the sheet-like filter material becomes clogged.

8. Filterng apparatus as claimed in claim 7, comprising a substantially cup-shaped trap disposed within the filter housing with the sheet-like filtering material between the trap and the filter housing and removeable through the opening in the reservoir, the trap having an open end positioned to receive the engine coolant delivered by the conduit means to the filter means and having a body portion in which the engine coolant so delivered can accumulate, the trap having at least one overflow hole disposed at the upper end of the trap whereby engine coolant accumulating in the trap can escape into the filter housing.

9. Filtering apparatus as claimed in claim 8 in which the trap comprises a first flange extending about at least a portion of the open end of the trap by means of which the trap is suspended in the filter housing from the rim of the reservoir neck, the flange being dimensioned so that the cap can be secured to the neck of the container with the first flange disposed between the rim of the reservoir neck and the cap.

10. Filtering apparatus as claimed in claim 9 in which the filter housing comprises a second flange extending about at least a portion of the open end of the cup-shaped body portion, by means of which second flange the filter housing is suspended in the interior of the reservoir from the rim of the reservoir neck, the second flange being dimensioned so the cap can be secured to the neck of the neck of the container with the second flange disposed between the rim of the reservoir neck and the first flange.

11. In combination with an internal combustion engine cooling system having overflow port means permitting overflow of liquid engine coolant when the cooling system overheats, and providing suction as the cooling system cools, a filtering apparatus comprising:

filtering means for removing debris from engine coolant passing through the filtering means, including filter inlet means for receiving engine coolant to be filtered and filter outlet means for releasing filtered engine coolant;

a reservoir in fluid communication with the filter outlet means for receiving and containing the filtered engine coolant;

conduit means for placing each of the filter inlet means and the interior of the reservoir into fluid communication with the overflow port means to permit flow of engine coolant therebetween; and, valve means for directing the flow of fluids through the conduit means so that in use (a) engine coolant overflowing from the overflow port means is forced through the filter means into the reservoir and, (b) the suction provided at the overflow port means when the cooling system cools draws filtered engine coolant from the reservoir.

12. The combination as claimed in claim 11 in which the conduit means comprise:

a coolant inlet conduit in fluid communication with the filter inlet means so that engine coolant can be passed through the coolant inlet conduit into the filter means; and, a coolant outlet conduit in fluid communication with the reservoir so that filtered engine coolant can be drawn through the coolant outlet conduit from the reservoir.

13. The combination as claimed in claim 12 in which the valve means comprise:

an inlet check valve disposed in the coolant inlet conduit to permit flow of engine coolant in the inlet conduit only towards the filter inlet means; and, an outlet check valve disposed in the coolant outlet conduit to permit flow of engine coolant in the outlet conduit only away from the reservoir.

14. The combination as claimed in claim 11 in which the filter means are located in the interior of the reservoir.

15. The combination as claimed in claim 14 in which:

the reservoir comprises a neck having a rim, an opening circumscribed by the rim and accessing the interior of the reservoir, and a cap for closing the opening; and, the conduit means deliver engine coolant to the filter inlet means through an aperture in the cap, whereafter the engine coolant can be drawn by gravity through the filter means into the reservoir.

16. The combination as claimed in claim 15 in which the filter means comprise:

a filter housing comprising a cup-shaped body portion having an open end disposed to receive engine coolant delivered through the cap, and having at least one aperture for releasing the engine coolant to the reservoir; and, a sheet-like filtering material replaceable through the opening in the reservoir and so disposed in the filter housing that engine coolant delivered to the housing by the conduit means passes through the sheet of filtering material before being released to the reservoir.

17. The combination as claimed in claim 16 in which the filter housing comprises at least one overflow aperture located above the sheet-like filter material when the sheet-like material is positioned in the filter housing to filter engine coolant, whereby engine coolant can escape from the filter housing when the sheet-like filter material becomes clogged.

18. The combination as claimed in claim 17 comprising a substantially cup-shaped trap disposed within the filter housing with the sheet-like filtering material between the trap and the filter housing and removeable through the opening in the reservoir, the trap having an open end positioned to receive the engine coolant delivered by the conduit means to the filter means and having a body portion in which the engine coolant so delivered can accumulate, the trap having at least one overflow hole disposed at the upper end of the trap whereby engine coolant accumulating in the trap can escape into the filter housing.

19. The combination as claimed in claim 18 in which the trap comprises a first flange extending about at least a portion of the open end of the trap by means of which the trap is suspended in the filter housing from the rim of the reservoir neck, the flange being dimensioned so that the cap can be secured to the neck of the container with the first flange disposed between the rim of the reservoir neck and the cap.

20. The combination as claimed in claim 19 in which the filter housing comprises a second flange extending about at least a portion of the open end of the cup-shaped body portion, by means of which second flange the filter housing is suspended in the interior of the reservoir from the rim of the reservoir neck, the second flange being dimensioned so the cap can be secured to the neck of the neck of the container with the second flange disposed between the rim of the reservoir neck and the first flange.

21. In an internal combustion engine cooling system having overflow port means permitting overflow of liquid engine coolant when the cooling system overheats and providing suction as the cooling system cools, a method of filtering the engine coolant, comprisinng the steps of:

(a) constraining engine coolant that overflows when the cooling system overheats to pass through a filter into a reservoir; and, (b) applying the suction produced at the overflow port means when the cooling system cools to the filtered engine coolant in the reservoir to draw the filtered engine coolant back into the cooling system.

* * * * *

Notice of Adverse Decisions in Interference

In Interference No. 102,390, involving Patent No. 4,343,353, J. Tsopelas, AUTOMOBILE RADIATOR FILTER, final judgement adverse to the patentee was rendered Sept. 5, 1990, as to claims 1, 2, 11, 12 and 21.

[*Official Gazette October 23, 1990*]